US005992519A

United States Patent [19]

Ramakrishnan et al.

[11] Patent Number: 5,992,519

[45] Date of Patent: Nov. 30, 1999

[54] REAL TIME MONITORING AND CONTROL OF DOWNHOLE RESERVOIRS

[75] Inventors: Terizhandur S. Ramakrishnan, Bethel; R. K. Michael Thambynayagam, Ridgefield, both of Conn.

[73] Assignee: Schlumberger Technology Corporation, Ridgefield, Conn.

[21] Appl. No.: 08/979,907

[22] Filed: Sep. 29, 1997

[51] Int. Cl.[6] ..... E21B 34/16; E21B 43/12; E21B 47/06

[52] U.S. Cl. ..... 166/250.15; 166/53; 166/250.01

[58] Field of Search ..... 73/152.01, 152.18; 166/250.01, 250.07, 250.15, 52, 53, 66, 373

[56] References Cited

U.S. PATENT DOCUMENTS

| | | | |
|---|---|---|---|
| 4,155,403 | 5/1979 | Hurst | 73/152.18 X |
| 4,676,313 | 6/1987 | Rinaldi | 166/250.15 |
| 5,467,823 | 11/1995 | Babour et al. | 166/250.01 |
| 5,597,042 | 1/1997 | Tubel et al. | 166/250.15 X |
| 5,662,165 | 9/1997 | Tubel et al. | 166/250.01 |
| 5,680,899 | 10/1997 | Waid et al. | 166/250.15 X |
| 5,819,848 | 10/1998 | Rasmuson et al. | 166/250.15 |
| 5,829,520 | 11/1998 | Johnson | 166/250.01 |

OTHER PUBLICATIONS

Ramakrishnan et al., "Testing injection wells with rate and pressure data", Sep. 1994, pp. 228–236.

Baker et al., "Permanent monitoring–looking at lifetime reservoir dynamics", Winter 1995, Oilfield Review, pp. 32–46.

Ramakrishnan, "Integrated Petroleum Reservior Management", Chapter 6, (1994) pp. 101–140.

*Primary Examiner*—George Suchfield

*Attorney, Agent, or Firm*—David P. Gordon; William B. Batzer

[57] ABSTRACT

The method for the active or automated control of the reservoir uses a reservoir model with available data such as seismic, log, and core data as inputs, and uses the reservoir model in conjunction with a reservoir simulation tool in order to determine a production strategy which will maximize certain criteria, e.g., profits. The production strategy may include fixed elements which are not easily altered once the wells go into production, and variable elements which can be adjusted without serious effort during production. The production strategy is implemented by drilling wells, etc., and fluids are then controllably produced from the reservoir according to the variable production strategy; i.e., fluid flow rates are monitored by sensors, and, by adjusting control valves, are kept to desired values (which may change over time) set according to the variable production strategy. According to another aspect of the invention, information gleaned as a result of the adjustments to the control means is used to update the reservoir model. As a result, the variable and fixed production strategies can be updated and implemented.

22 Claims, 3 Drawing Sheets

REAL TIME MONITORING AND CONTROL OF DOWNHOLE RESERVOIRS

BACKGROUND OF THE INVENTION

1. Field of the Invention

The present invention relates broadly to the production of oil from subsurface geological formations. More particularly, the present invention relates to methods and apparatus for real time control of oil exploitation through active intervention in the process of the oil reservoir exploitation.

2. State of the Art

It is well recognized in the art that the monitoring of fluid movement in subsurface formations is essential in improving oil recovery techniques. Only by monitoring the reservoir is it possible to intervene in the recovery process in order to maximize recovery.

For many years, monitoring was carried out via the periodic logging of cased wells. More recently, monitoring has evolved into the continuous monitoring of pressure, temperature, and flow rates within the wellbore (See, e.g., Baker et al., "Permanent Monitoring," *Oilfield Review,* 7(4) 32–46 (1995)). Such continuous acquisition of data, when properly analyzed, has had the benefit of reducing production loss, because the analysis of the data has led to occasional intervention in the recovery process.

For example, decisions regarding oil production are presently most often based on decline curve analysis. (See, A. Satter and G. Thakur, *Integrated Petroleum Reservoir Management, A Team Approach*, Pennwell Publishing Company, Chapter 6 (1994). A detailed analysis is often carried out using standard reservoir simulators where factors such as optimal production/injection well placement are studied. Using history matching technique, an update to the reservoir model is carried out. Reservoir simulation is then complemented with results from data obtained from the well. As a result, determinations are made as whether to intervene in the recovery process (e.g., in order to increase production) such as by using an acid treatment, a fracture job, infill drilling, or the drilling of new wells to produce unswept oil. (See, *Integrated Petroleum Reservoir Management*, id.)

While the present techniques of monitoring and occasional intervention in the production process are useful in increasing production and reducing costs, these techniques are not ideal because they do not control the reservoir production in the shortest time scale of practical relevance ("real time"), but rather are reactive in nature to conditions that may have changed over a long period of time.

SUMMARY OF THE INVENTION

It is therefore an object of the invention to provide to provide methods and apparatus for real time reservoir control.

It is another object of the invention to provide methods for the active and/or automated control of oil reservoirs.

It is a further object of the invention to provide methods for at least partially automating control of fluid in a reservoir in order to satisfy predetermined, updatable production criteria.

It is an additional object of the invention to use continuous monitoring of downhole data in conjunction with a reservoir model for the control of flow rates from a reservoir, wherein information gleaned from controlled changes is used to update the reservoir model.

In accord with the objects of the invention, the method for the active or automated control of the reservoir generally comprises: obtaining a reservoir model which uses available data such as seismic, log, and core data as inputs; using the reservoir model in determining a production strategy; producing fluids from the reservoir according to the production strategy under influence of control means; monitoring the production of fluids; and adjusting the control means (preferably in real time) to influence the production of fluids based on information obtained during monitoring. According to a further aspect of the invention, information gleaned as a result of the adjustments to the control means is used to update the reservoir model.

Reservoir models are well known in which each geological object (layer) or grid block is assigned property values. These property values are obtained from seismic, log, or core data; i.e., from information obtained using seismic tools on the formation surface, from information obtained from sonic, electromagnetic, nuclear, NMR, and other logging tools which traverse the formation in an open borehole or a cased well, from formation and well testing, and from information obtained from analysis of core samples taken from a borehole.

Production strategy involves a basis for making decisions regarding production, such as the maximization of profits based on discounted cash flow, return on investment, or pay out time. Using a simulation tool which relies on the reservoir model, and varying parameters such as well spacing, well orientations, completion options, depletion method, choice of flooding sequences, optimal injection rates (in injection wells), and optimal rates of depletion (rate of production in each producer well) as a function of time, the objective function (e.g., profits) may be maximized. The results of the optimization dictate a production strategy which may involve fixed elements which are not easily altered once the wells go into production, and variable elements which can be adjusted without serious effort during production. Fixed elements include the orientation of the wells, the number of wells per acre, etc. Variable elements include the rate of depletion of each well.

According to the invention, once a production strategy has been decided upon, fluids from the reservoir are produced according to the production strategy. Thus, wells are drilled based on the fixed production strategy. Production of oil (i.e., the fluid flow rates in the wells) is based on the variable production strategy. Fluid flow rates are monitored by sensors, and, by adjusting control valves, are kept to desired values (which may change over time) set according to the variable production strategy.

According to a further aspect of the invention, information gleaned over time regarding the reservoir is used to update the reservoir model, and as a result, the production strategy can be updated. The result can include changes in the variable production strategy, and even the fixed production strategy; e.g., additional wells may be drilled; producers may be changed to injectors (and vice versa), etc.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
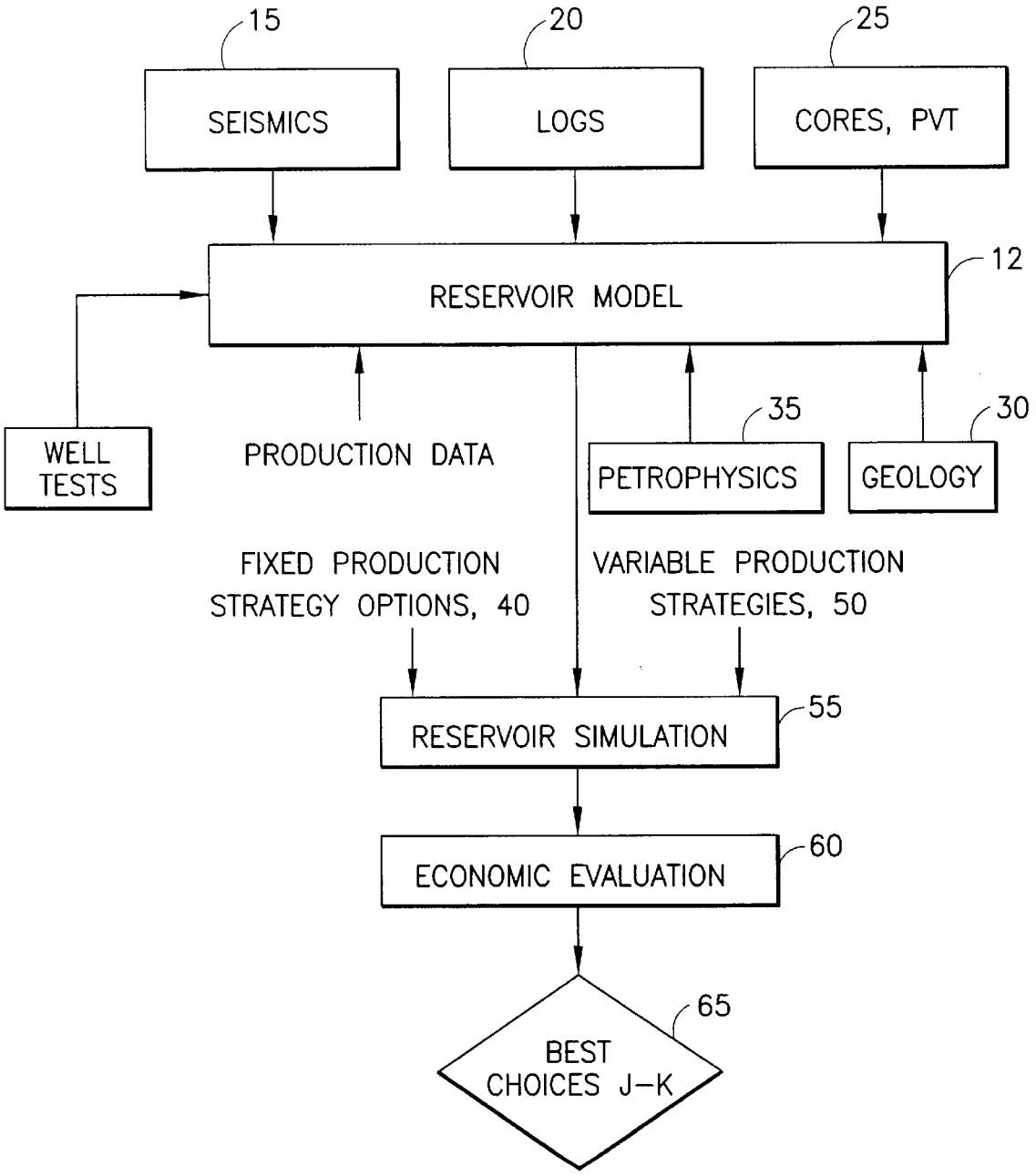
FIG. 1 is a block diagram of the method of the invention of determining a production strategy.

In accord with a first aspect of the invention, and as seen in FIG. 1, a method is provided for determining production strategy for an oil reservoir. In particular, a reservoir model such as the Strata Model (sold by Halliburton Company, Texas) is provided at 12. The reservoir model permits the formation to be characterized as a plurality of geological objects (e.g., layers), or as a grid, and permits values to be assigned to properties of the formation for each object or element of the grid. Input values to the reservoir model for the formation properties are obtained from results of using seismic tools 15 on the formation surface, from results of information obtained from sonic electromagnetic, NMR, nuclear, and other logging tools 20 which traverse the formation in an openhole borehole or cased well, and from results of information obtained from analysis of core samples 25 taken from a borehole. In addition, physical properties of formation fluids are provided at 25, including pressure-volume-temperature (PVT) relationships, etc. In addition, any additional available geological information 30 (e.g., known layering) is provided to the reservoir model, as is petrophysics information 35 which includes the interpretation of porosity, saturation, capillary pressure, permeability, fluid mobilities, etc. Based on all of the information, the formation is initially characterized with values for its properties, preferably including porosity, permeability, water and oil saturations, lithology, etc.

As seen in FIG. 1, with the starting values for formation parameters, and in conjunction with fixed production strategy options 40 and variable production strategy options 50, a simulation tool such as ECLIPSE (sold by GeoQuest, Houston, Tex.) can be run at 55 to simulate the formation so that economic evaluations can be made at 60. By optimizing the economic evaluations (e.g., maximizing profits based on discounted cash flow, return on investment, pay out time, or other criteria), a "best" fixed production strategy in conjunction with a "best" variable production strategy can be chosen at 65. More particularly, the fixed production strategy options 40 include parameters such as well spacing, well orientations, completion options (e.g., perforation numbers and locations, or "intelligent completion options" which permit changing, selective completion combinations), while the variable production strategy options include parameters such as flooding sequences, "intelligent completion" control, and optimal rate of depletion (i.e., the rate of production in each well and their relationships as a function of time). By exploring the parameter domain of the production strategies relative to the reservoir model, the objective function of maximizing profits can be maximized. In order to reduce computation, clearly non-viable parameter domain combinations may be ruled out prior to running the simulations. Also, if desired, expert systems can be developed with respect to reservoir environments and prior knowledge in order to limit the parameter domains and thereby reduce the intensive computation.

Figure 2:
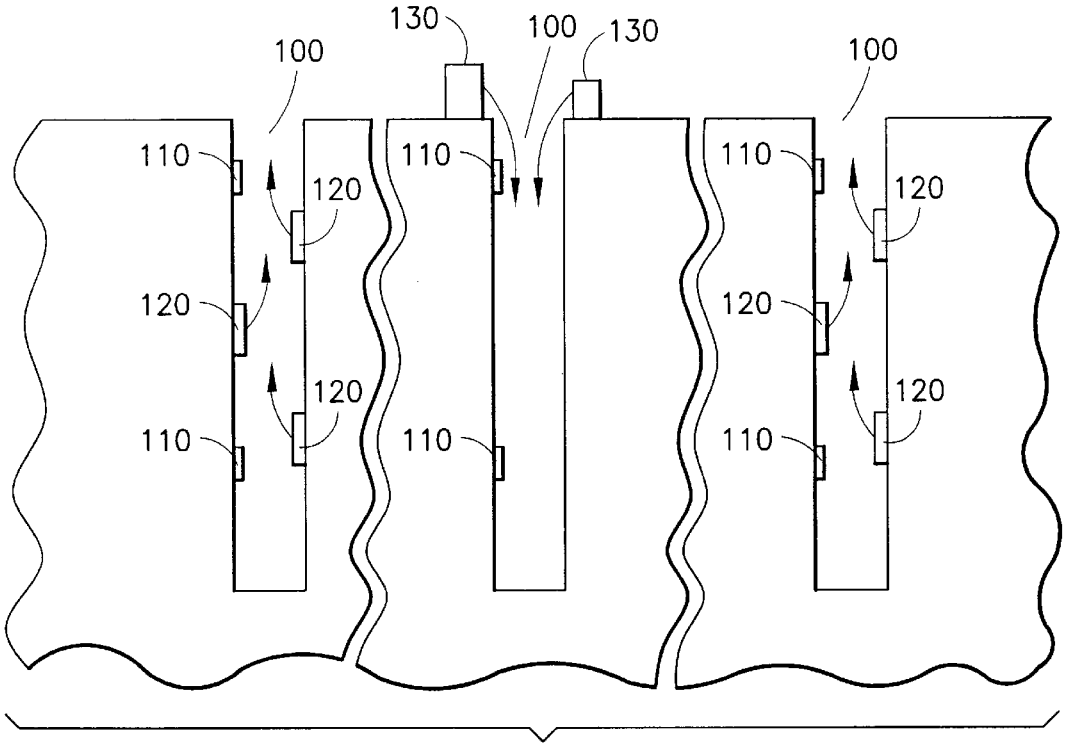
FIG. 2 is a schematic diagram of an oilfield having a plurality of wells with flow control apparatus and sensors.

Once the production strategy has been chosen, the reservoir is exploited accordingly. Thus, if necessary, wells 100, as seen in FIG. 2, are drilled according to the optimally determined well spacing and well orientation, and are completed according to the determined optimal methods. In completing the wells, flow rate and pressure sensors 110 may be permanently provided in the casing, in the borehole. Alternatively, flow rate and pressure sensors may be dangled in the wellbore, or included on production logging tools which are periodically run in the wells. If desired, fixed resistivity sensors may also be provided. In addition, control valves 120 are provided on the producer wells, while controllable pumps 130 are provided on the injector wells. If desired, control valves may also be provided on the injector wells. With the completed wells in place, the depletion method chosen according to the "best" variable production strategy is used to start producing fluids from the formation. Using the control valves 120, the fluids are produced from the formation at the desired depletion rate pursuant to the production strategy. In order to ensure that the fluids are produced at the desired rate, the flow rates of the fluids are monitored using the sensors 110 (or other fluid flow rate sensors in the well). The difference between the sensed flow rate and the desired flow rate is used as an error signal which produces feedback to the valves 120 and/or pumps 130 as discussed in more detail below with reference to FIG. 3. Thus, the valves and/or pumps are controlled in real time to maintain the desired flow rates in the wells as determined by the production strategy.

Control of the flow rate may be quantitatively understood mathematically. In particular, the formation can be considered a nonlinear system. In designing flow control, for simplicity, it is preferable that the nonlinear system be quasilinearized. After quasilinearization, the sandface flow rate $q_j$, i.e., the flow rate in the formation layer of interest, and the formation pressure $p_j$ in well j are related through the known equation $$p_j(t) = p_0 - \sum_i G_{ij}(\delta t) \circ q_i(t) \tag{1}$$

where $p_0$ is the original reservoir pressure before production, $\delta$ is a small number, $G_{ij}$ ($\delta t$) is a slowly varying time dependent response function of the formation layer of interest, and $\circ$ designates a convolution integral. Conceptually, this equation is deducible by appreciating that the time scale for saturation movements are large compared to pressure propagation in the formation, provided the formation fluids are only slightly compressible (See, Ramakrishnan, T. S. and Kuchuk, F.: "Testing and Interpretation of Injection Wells Using Rate and Pressure Data", *SPE Form. Eval.* 9, pp. 228–236 (1994)).

For purposes of illustration, it is assumed that the well N has a specified production rate schedule which is based on the production strategy, and that the ratio of production rates between other wells j to the well N is also defined according to the production strategy. According to the invention, it is the sandface production rate and not the pressure which determines the position of the saturation contours in the formation. Thus, by controlling the flow rates and rate relationships among the wells, regardless of damage to the production system or the wellbore, the saturation contours will remain as close as possible to the values intended by the production strategy.

The flow rates and rate relationships among wells can be controlled through the use of downhole valves. The valve coefficient $K_v$ of a well in the system may be adjusted by moving an electrically or hydraulically operable stem (not shown). With a valve in the system, the sandface flow rate $q_j$ and the downhole sandface pressure $p_j(t)$ may be related (assuming a surface pressure of zero for simplicity) by $$p_j(t)=K_{vj}q_j^m(t)+S_j(t)q_j(t) \tag{2}$$

where $K_v$ is the valve coefficient, m is a known exponent for the valve, and $S_j(t)$ is a time dependent, dimensionless skin factor multiplied by a constant that relates flow rate to pressure. The first term of the right side of equation (2) is effectively the pressure drop due to the valve, while the second term of the right side of equation (2) is effectively the pressure drop to the skin of the well. In conventional control jargon, $S_j$ can be considered a disturbance variable whose effect on altering the fluxes is rectified by adjusting $K_v$. The setting of the valve coefficient $K_v$ in a predetermined controller design such as a proportional design, or proportional-integral design depends on the errors $$e_N(t)=1-(q_N(t)/q_{sN}(t)) \tag{3}$$

$$e_j(t)=r_{sj}(t)-(q_j(t)/q_N(t)) \tag{4}$$

where $q_{sN}$ is the desired flow rate in well N, and $r_{sj}$ is the desired ratio of flow rates in well $j \neq N$ and well N; i.e., $q_{sj}(t)=r_{sj}(t)q_{sN}(t)$.

From equations (1)–(4), it is evident that in order to maintain a constant flow rate, the control valve has to correct for changes in skin factor. If the reservoir model is exact and if the governing equations are accurate representations, than the valve coefficient is defined by $$K_{vsj}(t)=\frac{p_0-\sum G_{ij}(\delta t)\circ q_{si}(t)-S_j(t)q_{sj}(t)}{q_{sj}^m} \tag{5}$$

Based on equation (5), it is seen that when the offset according to equations (3) and (4) is zero, the valve coefficient changes only due to the skin factor disturbance variable $S_j(t)$. An estimate of the skin factor at any given instant is obtained using $$S_j=\frac{1}{q_j(t)}\left[p_0-\sum G_{ij}(\delta t)\circ q_i(t)-p_{wj}\right] \tag{6}$$

where $p_{wj}$ is the measured wellbore pressure.

While it might be assumed from equation (6) that by measuring the wellbore pressure $p_{wj}$ and the fluid production $q_j(t)$, one can solve for $S_j$ at all times and can therefore plug this solution into equation (5) thereby using the wellbore pressure to control fluid flow, in practice, this is not the case because the values $G_{ij}$ are changing over time. Thus, according to the invention, the valve coefficient must be changed based on a determination of flow rate according to a controlled feedback arrangement.

Figure 3:
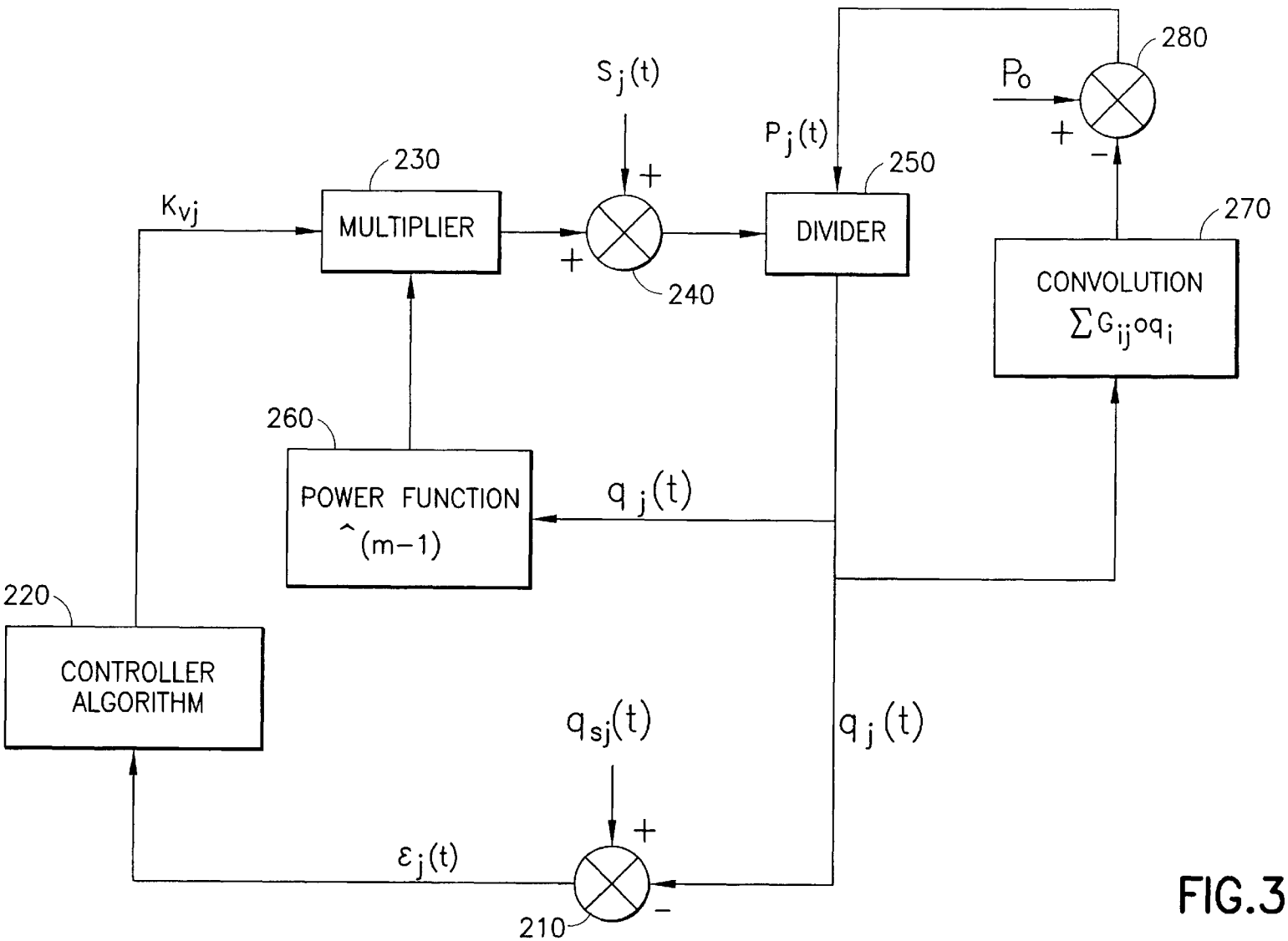
FIG. 3 is a signal flow diagram for controlling the flow control apparatus of FIG. 2.

Turning to FIG. 3, a signal flow diagram representing the feedback system of the invention is seen. In particular, it is seen that in a feedback system, the actual production rate $q_j$ from a well is compared to the desired rate $q_{sj}$ at 210 to provide an error signal $e_j$. The relationship between the valve coefficient $K_v$ and the error signal e may be parameterized in terms of a vector of parameters $\alpha$. The error signal for each well is provided to a controller which is designed to optimize $\alpha$ to satisfy an objective function. In particular, in the preferred embodiment of the invention, a controller 220 is designed to minimize the integral of the deviation I between the measured fluxes ($q_i(t)$) and the desired flux ($q_{si}(t)$) around the nominal values of the formation properties; i.e., to minimize the equation $$I=\int_0^t \sum_i ([q_i(t)-q_{si}(t)])^2\,dt \tag{7}$$

with respect to $\alpha$. The values of $\alpha$ obtained by this procedure will depend on the formation properties, and the skin factor. As previously shown, the nominal value of $K_v=K_{vs}$ is very dependent on these quantities. The relationship between $K_v$ and e can be defined by $$K_{vj}(t)=K_{vsj}(t)+f(e_i(t),\ i=1\ldots N,\ \alpha)\forall j \tag{8}$$

When $e_j(t)=0$ for all wells, the valve coefficients are equal to the nominal value. To minimize I in equation (7), several choices are possible. At any given nominal value, I may be minimized for a fixed fractional change in the skin factors. This ensures that a quick stabilization to a new $K_v$ for the desired rates is possible.

As seen in FIG. 3, the $K_v$ for a well is multiplied at 230 by $q_j(t)^m-1$ (obtained from feedback loop 230, 240, 250, 260), with the product being added at 240 to $S_j(t)$. That sum is divided at 250 by $p_j(t)$ to provide the sandface flow rate $q_j(t)$ in accord with equation (2) above. The flow rate $q_j(t)$ is provided to the power function block 260 which generates the value $q_j(t)^m-1$ for multiplication by $K_{vj}$ at 230. It is noted that the sandface flow rate $q_j(t)$ is shown as part of loop 250, 270, 280 to relate to the formation pressure according to equation (1) above. Thus, at 270, the sandface flow rate $q_j(t)$ is convolved with $G_{ij}$ and summed, and at 280, the summed convolution is subtracted from $p_0$ in order to provide $p_j(t)$.

It is possible in certain circumstances (e.g., skin damage) that there may exist no value $K_v$ which will maintain the desired flow rate in a particular well. In such an event, the production goals based on the variable production strategy become inapplicable as a limit on the potential deliverability of the well is reached. When the variable production strategy can no longer be followed, reevaluation is necessary. The result of reevaluation may be invasive action (e.g., an acid flush) to remedy the skin, or a change in the production strategy to reduce the desired production rate in the particular well.

Figure 4:
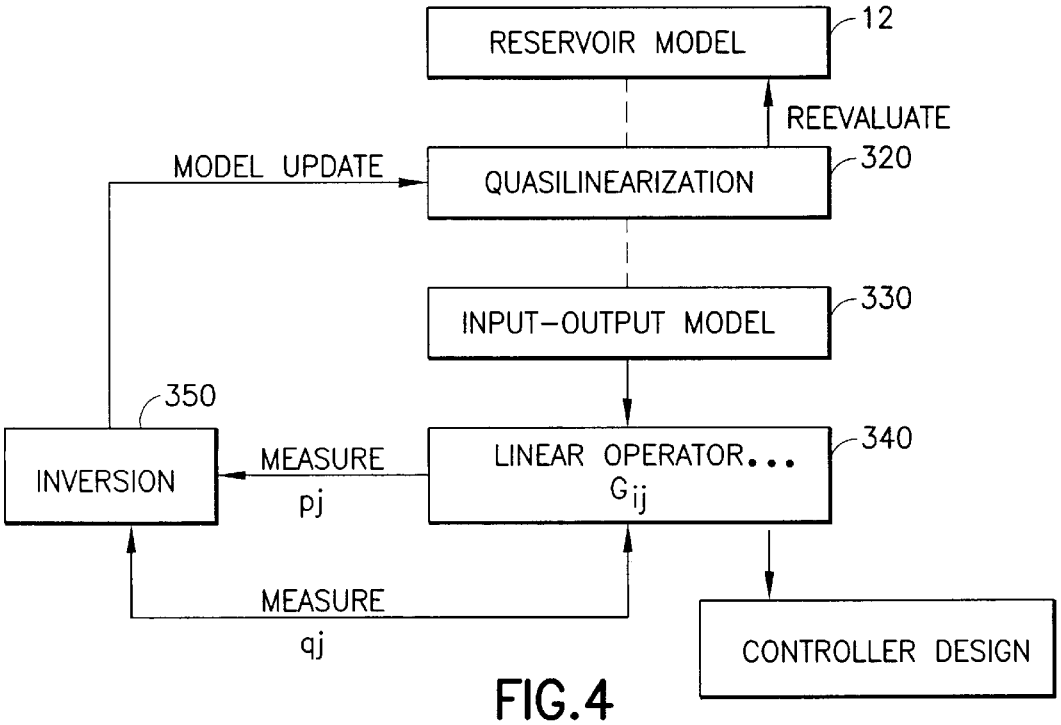
FIG. 4 is a block diagram of the method for updating the reservoir model used in determining production strategy.

It should be appreciated by those skilled in the art that changes in the flow rate, whether due to meeting the variable production strategy, or due to other variables, cause pressure transients. According to another aspect of the invention, the pressure transients, which contain information regarding the response function $G_{ij}$, are used to refine values for the response function $G_{ij}$ which are used in the reservoir model. Thus, as seen in FIG. 4, the reservoir model 12 is quasilinearized at 320 to provide an input-output model 330. The input-output model 330 relates pressures, fluid flow, and the response function according to equations (1)–(6) above, with the response function 340 being used for controller design according to equations (7) and (8) above. When the flow rate $q_i$ is changed, the measured pressure transient can be used with the measured flow rate, using equation (1) and deconvolution (i.e., via inversion 350), to provide a determination of the linear operators $G_{ij}$. The new values for the linear operators $G_{ij}$ are then used to update the quasilinearization 320, which in turn causes a change to the input-output model 330 and updates the response function 340. In addition, based on the new information, the reservoir model 12 can be updated, and the procedure described above with reference to FIG. 1 followed in order to generate a new variable production strategy and/or a new fixed production strategy. In addition, the new values for the linear operators $G_{ij}$ are preferably provided to the convolution function 270 of the flow control system of FIG. 3 for purposes of relating measured and expected flow rates. This, in turn will effect the determination of valve coefficients $K_{vj}$ which are used in controlling the flow of fluid from the formation.

There have been described and illustrated herein methods and apparatus for real time control of oil exploitation through active intervention in the process of the oil reservoir exploitation. While particular embodiments have been described, it is not intended that the invention be limited thereto, as it is intended that the invention be as broad in scope as the art will allow and that the specification be read likewise. Thus, while certain equations governing the relationship between pressure and flowrates have been provided, it will be appreciated that other equations could be utilized. For example, measurements of flow rate can be affected by the compressibility of fluids in the borehole depending upon the location of the measurement. Thus, if the volume of fluid between the sandface and the measurement point is $V_j$, then $c_j V_j (dp_{wj}/dt)=q_j-q_{Tj}$, where c denotes the compressibility of the fluid and $q_{Tj}$ is the measured rate at the measurement point, and the flow equations must be modified accordingly. Also, while particular reservoir models and simulation tools were referenced, it will be appreciated that other models and tools could be utilized. Further, while the invention was described with reference to both fixed and variable production strategies, it will be appreciated that the invention can be used with reference to variable production strategies only if desired. It will therefore be appreciated by those skilled in the art that yet other modifications could be made to the provided invention without deviating from its spirit and scope as so claimed.

We claim:

1. A method for the active or automated control of a reservoir in a formation, comprising:

a) using a reservoir model, with previously determined information regarding the formation as an input thereto, to determine a preferred production strategy for the reservoir, said preferred production strategy including a desired production flow rate from a well in the formation;

b) producing fluids from the well;

c) using sensing means, monitoring a flow rate at which said fluids are produced from the well;

d) comparing said flow rate of said monitoring with said desired production flow rate to obtain a difference signal; and e) adjusting a valve control means by minimizing an indication of said difference signal with respect to at least one parameter which relates said difference signal to a valve coefficient of said valve control means, in order to cause said fluids to be produced from the well at substantially said production flow rate according to said production strategy.

2. A method according to claim 1, wherein:

said monitoring a flow rate and said adjusting a valve control means occur in real time.

3. A method according to claim 1, wherein:

said preferred production strategy includes a preferred variable production strategy with a plurality of first parameters, said plurality of first parameters including at least one of a depletion method, a flooding sequence, and said flow rate.

4. A method according to claim 3, wherein:

said preferred production strategy includes a preferred fixed production strategy with a plurality of second parameters including at least one of well spacing, well orientations, and a completion option.

5. A method according to claim 1, wherein:

said reservoir model characterizes the formation into a plurality of geological objects which are assigned properties and values based on said previously determined information.

6. A method according to claim 5, wherein:

said previously determined information includes information obtained from at least one of seismic exploration of said formation, geological coring of said formation, and logging said formation with a borehole tool.

7. A method according to claim 1, wherein:

said reservoir model characterizes the formation into a grid of blocks, each block having assigned properties and values based on said previously determined information.

8. A method according to claim 7, wherein:

said previously determined information includes information obtained from at least one of seismic exploration of said formation, geological coring of said formation, and logging said formation with a borehole tool.

9. A method according to claim 1, wherein:

said using a reservoir model to determine a preferred production strategy includes using a reservoir simulation tool which relies on said reservoir model, and based on said reservoir simulation tool and said reservoir model, conducting an economic evaluation of a plurality of production strategies, with said preferred production strategy being one of said plurality of production strategies.

10. A method according to claim 1, further comprising:

after determining said preferred production strategy, and prior to said producing, drilling wells in said formation based on said preferred production strategy.

11. A method according to claim 1, further comprising:

after determining said preferred production strategy, and prior to said producing, locating said sensors in the well.

12. A method according to claim 1, further comprising:

measuring pressure transients in the well, and using information obtained from said measuring to update said reservoir model.

13. A method according to claim 12, further comprising:

with an updated reservoir model, determining a new preferred production strategy for the reservoir, and adjusting the control means to cause said fluids to be produced from the well according to said new preferred production strategy.

14. A method for the active or automated control of a reservoir in a formation, comprising:

a) using a reservoir model, with previously determined information regarding the formation as an input thereto, to determine a preferred production strategy for the reservoir, said preferred production strategy including a desired production flow rate from a well in the formation;

b) producing fluids from the well;

c) using sensing means, monitoring a flow rate at which said fluids are produced from the well;

d) based on said monitoring, adjusting a control means in order to cause said fluids to be produced from the well at said production flow rate according to said production strategy;

e) measuring pressure transients in the well; and f) using information obtained from said measuring to update said reservoir model;

with an updated reservoir model, determining a new preferred variable production strategy for the reservoir, and adjusting the control means to cause said fluids to be produced from the well according to said new preferred variable production strategy.

15. A method according to claim 1, wherein:

said preferred production strategy includes production flow rates from a plurality of wells in the formation, said producing fluids comprises producing fluids from said plurality of wells;

said monitoring comprises monitoring flow rates at which said fluids are produced from said plurality of wells;

said adjusting a valve control means comprises adjusting control valve means in each of said plurality of wells to cause said fluids to be produced from said plurality of wells at substantially said production flow rates according to said production strategy.

16. A system for the active or automated control of a reservoir in a formation traversed by a plurality of wells, comprising:

a) a reservoir model means having previously determined information regarding the formation as an input thereto, said reservoir model means for determining a preferred production strategy for the reservoir, said preferred production strategy including a desired production flow rate from at least a designated one of the wells in the formation;

b) production means for producing fluids from the designated well, said production means including adjustable control means for controlling a rate at which the fluids are produced from the designated well; and c) sensing means for monitoring a flow rate at which the fluids are produced from the designated well, said sensing means being coupled to said adjustable control means in a feedback loop, said adjustable control means including means for comparing said flow rate monitored by said sensing means with said desired production flow rate to obtain a difference signal, and means for minimizing an indication of said difference signal with respect to at least one parameter which relates said difference signal to a valve coefficient of said control means in order to cause said fluids to be produced from the designated well at substantially said production flow rate according to said production strategy.

17. A system according to claim 16, further comprising:

means for measuring pressure transients in the well, wherein indications of said pressure transients are provided to said reservoir model means for updating said reservoir model.

18. A system according to claim 16, wherein:

said preferred production strategy includes a preferred variable production strategy with a plurality of first parameters, said plurality of first parameters including at least one of a depletion method, a flooding sequence, and said flow rate, and said preferred production strategy includes a preferred fixed production strategy with a plurality of second parameters including at least one of well spacing, well orientations, and a completion option.

19. A system according to claim 16, wherein:

said preferred production strategy includes an injection rate into an injector well of the formation.

20. A method according to claim 14, wherein:

said preferred production strategy includes a preferred variable production strategy with a plurality of first parameters, said plurality of first parameters including at least one of a depletion method, a flooding sequence, and said flow rate.

21. A method according to claim 20, further comprising:

with an updated reservoir model, determining a new preferred variable production strategy for the reservoir, and adjusting the control means to cause said fluids to be produced from the well according to said new preferred variable production strategy.

22. A system for the active or automated control of a reservoir in a formation traversed by a plurality of wells, comprising:

a) a reservoir model having previously determined information regarding the formation as an input thereto, said reservoir model including (i) means for determining a preferred production strategy for the reservoir, said preferred production strategy including a production flow rate from at least a designated one of the wells in the formation, and (ii) update means for updating said reservoir model based on additional information obtained regarding said designated well;

b) production means for producing fluids from the designated well, said production means including adjustable control means for controlling a rate at which fluids are produced from the designated well;

c) sensing means for monitoring a flow rate at which the fluids are produced from the designated well, said sensing means being coupled to said control means in a feedback loop in order to cause said fluids to be produced from the designated well at said production flow rate according to said production strategy; and d) means for measuring pressure transients in the designated well, wherein indications of said pressure transients are provided to update means for updating said reservoir model.

* * * * *